US007420169B2

(12) United States Patent
Parks et al.

(10) Patent No.: US 7,420,169 B2
(45) Date of Patent: Sep. 2, 2008

(54) DICOROTRON WIRE ASSEMBLY REMOVAL-INSERTION TOOL

(75) Inventors: Bruce J. Parks, Bloomfield, NY (US); Jamie S. Clayfield, Rochester, NY (US); Douglas S. Smith, Rochester, NY (US); James D. Walsh, Rochester, NY (US); Eliud Robles Flores, Webster, NY (US); Gerald F. Daloia, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 415 days.

(21) Appl. No.: 11/235,935

(22) Filed: Sep. 27, 2005

(65) Prior Publication Data

US 2007/0069129 A1 Mar. 29, 2007

(51) Int. Cl.
*H01T 19/00* (2006.01)

(52) U.S. Cl. ..... 250/324; 250/325; 250/326; 399/109; 399/115; 361/225; 29/700; 29/225; 29/221

(58) Field of Classification Search ..... 250/324, 250/325, 326; 399/109, 115; 361/225; 29/700, 29/225, 221
See application file for complete search history.

(56) References Cited

U.S. PATENT DOCUMENTS 2,297,691 A 10/1942 Carlson
5,449,906 A * 9/1995 Osbourne ..... 250/324
6,787,774 B1 * 9/2004 Rumpel et al. ..... 250/325

* cited by examiner

*Primary Examiner*—Jack I. Berman
*Assistant Examiner*—Michael Maskell
(74) *Attorney, Agent, or Firm*—James J. Ralabate

(57) ABSTRACT

Electrostatic printing processes utilize corona-charging units. When those units wear out or become faulty, they need to be replaced. This embodiment provides a tool that can be used to remove a faulty electrode wire assembly from the unit. This same tool when loaded with a new wire assembly can insert a new wire assembly into the emptied corona charging unit, sometimes referred to as a dicorotron unit. The tool, therefore, is used both to remove or insert a wire assembly from or into a dicorotron unit.

10 Claims, 5 Drawing Sheets

DICOROTRON WIRE ASSEMBLY REMOVAL-INSERTION TOOL

CROSS REFERENCE

Illustrated and disclosed in co-pending applications, all owned by the present assignee, application Ser. No. 11/235,936 and 11/235,937, are applications relating to dicorotrons used in an electrostatic process. These two applications and the present application are filed concurrently herewith. The disclosures of these two applications are totally incorporated herein by reference.

In application Ser. No. 11/235,936 concurrently filed herewith, a dicorotron wire assembly removal and storage tool is disclosed and claimed. In 11/235,936, a storage box is provided having a removal tool mounted on its top portion. The removal tool is situated above an opening in the box through which a removed wire assembly will fall after being removed from the dicorotron unit. The box provides a storage and collection bin for all of the removed faulty wire assemblies.

In application Ser. No. 11/235,937, a new structure for holding a wire assembly in place is disclosed and claimed. Since it has become necessary to remove faulty wire assemblies from a dicorotron unit, any significant provision which simplifies this removal procedure is important. In this 11/235,937 application, a wire assembly(s) is snapped into mating plastic inserts which in turn attaches to the dicorotron housing. This allows for easier installation of new wire assemblies and for easier removal of old wire assemblies using various removal methods and apparatuses.

The present embodiments relate to corona charging in an electrostatic copying process and, more specifically, to an apparatus and system for removing and replacing faulty corona wire assemblies.

BACKGROUND

Electrostatography is best exemplified by the process of xerography as first described in U.S. Pat. No. 2,297,691 to C. F. Carlson. In this process, the photoconductor is first provided with a uniform electrostatic charge over its surface and is then exposed to imagewise activating electromagnetic radiation which selectively dissipates the charge in illuminated areas of the photoconductor while the charge in the non-illuminated areas is retained thereby forming a latent electrostatic image. This latent electrostatic image is then developed or made visible by the deposition of finely-divided electroscopic marking particles referred to in the art as "toner". The toner will normally be attracted to those areas of the layer which retain a charge, thereby forming a toner image corresponding to the latent electrostatic image. This powder image may then be transferred to a support surface such as paper. The transferred image may subsequently be permanently affixed to the support by heat fusing. Instead of forming a latent image by uniformly charging the photoconductive layer and then exposing the layer to a light and shadow image, a latent image may be formed by charging an insulating or photoconductive insulating member in image configuration. The powder image may be fixed to the imaging member if elimination of the powder image transfer step is desired.

Several methods are known for applying an electrostatic charge to the photosensitive member such as the use of electron-emitting pins, an electron-emitting grid, single corona-charging structures and multiple dicorotron wire assemblies. In recent development of high speed xerographic reproduction machines where copiers can produce at a rate of or in excess of three thousand copies per hour, the need for several reliable dicorotron wire assemblies in order to utilize the full capabilities of the reproduction system is required. Also, with the advent of color copiers where several corona-charging stations are needed, the requirement for dependable dicorotron wire assemblies for depositing an electrostatic charge is essential.

Generally, in electrostatographic or electrostatic copy processes, a number of corotrons or dicorotrons are used at various stations around the photoreceptor. For example, the dicorotrons are used at the station that places a uniform charge on the photoreceptor, at a transfer station, at a cleaning station, etc. In today's high speed copiers, it is important that all corotrons (or dicorotrons) are in perfect working order since corotron malfunction can easily render the entire copying process useless. Some high speed copiers, including color copiers, use several dicorotron units, as many as sixteen corotron or dicorotron units are used. Maintaining each corotron unit in perfect working order is essential to the proper functioning of these complex fast color copiers. It is common to use one or several corona-generating device(s) ("corotron" or "dicorotron") for depositing the electrostatic at the above-noted stations. Generally, the structure of a dicorotron uses a thin, glass-coated wire mounted between two insulating anchors or end blocks called "insulator barriers", which support the wire in a spring-tensioned manner in a singular plane. These anchors are installed between flexible grippers, holders or clamps or anchor inserts that maintain the insulators in place. These insulator inserts are fixed at two opposite ends of a U-shaped dicorotron "housing" or "shells" or "shield". The wire or corona-generating electrode is typically a highly conductive elongated wire situated in close proximity to the photoconductive surface to be charged. Often the corona discharge electrode is coated with a dielectric material such as glass. Glass coating improves charging uniformity throughout the electrode's life. Since the wire electrode is comprised of a thin outer glass brittle coating, it may be easily damaged. Some handling or cleaning of this electrode often results in fracture of the glass coating, which could cut or injure the user. While cleaning sometimes corrects problems in this corona electrode, it is sometimes necessary to replace the wire due to degradation in the corona performance or even in breakage of the electrode which could occur during the cleaning.

Manual handling of the glass-coated wire is not recommended nor is the use of prying tools, such as screw drivers or rigid prying objects. Extreme care needs to be observed in changing the corona electrodes or wires. As above noted, because of the large number of dicorotrons or wires needed in some copiers, malfunctioning of these wires presents a formidable problem in today's complex copiers.

Another important consideration is the high costs of dicorotron assemblies. The most expensive major component in the dicorotron assembly is the housing or U-shaped shield which houses the wire assembly and the wire anchors usually called insulators. The least expensive major component in the dicorotron assembly is the wire electrode. It makes sense, therefore, for the faulty wire assembly to be removed and replaced rather than the expensive entire dicorotron unit or assembly made up of the wire assembly and U-shaped housing.

There are some systems used to remove and replace wire assemblies from the U-shaped housing, such as the method disclosed in U.S. Pat. No. 5,449,906 (Osbourne). In this prior art system, the U-shaped housing has apertures on its end portions adjacent to the electrode anchors or insulators. A prying tool is then inserted into this aperture to pry or dislodge the two end anchors from their original position thereby removing the two insulators or anchors and the attached wire electrode. A tool for replacing the removed wire assembly in Osbourne's process includes a plurality of replacement electrodes mounted on a rigid support frame. Replacement is accomplished by pressing this support frame containing a plurality of corona-generating wire assemblies against the empty U-shaped housing (where old wire has been removed) and thereby replacing the removed wire electrode with a new wire electrode. This prior art process requires prying or dislodging the old wire through an aperture and replacing the old wire with a mounting system where a plurality of corona-generating electrode assemblies are removably mounted in a configuration matching that of the original configuration.

SUMMARY

In the present embodiments, a system is provided whereby a dicorotron wire assembly removal and insertion tool is used that both removes the old wire assembly and then installs a new wire assembly. The present system has a built-in lever-projection feature used to dislodge the old wire assembly so the tool can capture it. Sequentially, an empty tool removes the old wire assembly from the dicorotron unit, and the old wire assembly housed in the removing tool is disposed of. Then a loaded tool (with a new wire assembly housed therein) is pressed over the now empty dicorotron unit and unloads the new wire assembly therein. The insertion tool aligns the new anchor grippers with the apertures in the housing. This now leaves an empty tool which then can be used to remove a wire assembly from a second dicorotron unit, etc. Thus, the first removal step involves taking an empty removal tool, snapping it over a U-shaped dicorotron unit (containing the old wire assembly), pressing two levers on each side of the tool whereby the levers pry loose the wire assembly and deposit it in the removal tool. The wire assembly comprises a wire strung between two insulator anchors. The removal tool has two levers with projections which, when pressed inwardly, pass through slots in the tool into aligned apertures in the dicorotron unit. After passing through the slots and apertures, the projections pry out the anchors from their seating or grippers and dislodge the wire assembly. In an embodiment of the present device and system, a method is provided for safe removal of the dicorotron wire assembly at the customer site by tech-reps or customers. Faulty wire assemblies in this embodiment are removed by placing an empty dicorotron removal-insertion tool on a damaged dicorotron unit and pressing two release levers to dislodge from the dicorotron housing the two anchors with the attached wire electrode. This procedure keeps the tech-rep and/or customer safe from the glass-coated wire since the user never touches the old used-up faulty wire assembly. When the old wire assembly is dislodged from the U-shaped housing by the removal tool, it can be disposed of in any suitable manner. The removal tool has two flexible levers located at each of its ends, each lever has projecting from it a pin or projection which is in alignment with both a slot opening in the removal tool and an aperture in the old U-shaped housing. The inside pointing projections of the levers travel through the slot (in the tool) and the apertures (in the U-shaped assembly) to contact and dislodge the grippers that hold the anchors.

This removal operation requires no manual prying tool to reach into the U-shaped assembly to dislodge the anchor-wire structure. The flexible levers with the projecting pins easily protrude through the slots and apertures to thereby release the old attached wire assembly. The removal tool is usually a molded plastic structure having these release levers molded in as one piece. The pins, in effect, push into the anchor seating and dislodge or force the anchors out from the dicor housing releasing the entire wire assembly.

The new replacement wire assembly is inserted or installed into the emptied original U-shaped unit housing by a wire assembly replacement and insertion tool containing a new wire assembly. In one embodiment, installation of the new wire assemblies is accomplished by placing a new insertion or replacement tool over the empty old dicorotron U-shaped housing and pressing the wire assembly in place, snapping into the apertures of the housing. In the wire installation, the wire replacement insertion tool is shipped to the user with a new wire assembly inside of it. The anchors are correctly positioned in the housing apertures by release features on each end of the tool. The new tool/wire assembly is then positioned over the empty old dicorotron shell (U-shaped housing) and snapped in place. Then the tool is pulled upwards while pushing the thumbs through openings on top of the tool to release a new wire assembly into the empty dicorotron U-shaped housing.

The embodiments disclosed herein provide a tool enabled to both remove and insert a wire assembly in a dicorotron unit. This tool, when devoid of a wire assembly is adapted to remove a faulty used wire assembly from a dicorotron unit in a removal step. The tool, (a second identical tool) when armed with a new wire assembly, is adapted to insert and deposit the new wire assembly in the dicorotron unit housing in a deposit step. This tool comprises structures to both remove and insert a wire assembly from and into a dicorotron unit. The tool has substantially the same outer configuration of the dicorotron unit except the tool has dimensions that will permit the dicorotron unit to fit and nest therein. In an embodiment the tool has removal levers located at each end of the tool. These removal levers have projections adapted to dislodge a used wire assembly from a dicorotron unit. The tool has slots therein that will align both with apertures in the dicorotron unit and with projections located in the levers of the tool. The tool is enabled after the deposit step and emptied of the wire assembly to provide a tool to remove a wire assembly in a removal step involving a second dicorotron unit with a faulty wire assembly. The tool of this embodiment is enabled to both remove and deposit a wire electrode assembly in a dicorotron unit. The tool has a configuration enabled to mate with a dicorotron unit. Also, the tool being slightly larger than the dicorotron unit is adapted to receive the dicorotron unit in a manner whereby the dicorotron unit can nest therein. The tool, when devoid of a wire assembly, is adapted to remove a faulty used wire assembly from a dicorotron unit in a removal step. The tool, when loaded or armed with a new wire assembly, is adapted to deposit the new wire assembly in a heretofore empty dicorotron unit in a deposit step. The wire assembly comprises a wire electrode strung between two insulating anchors. The anchors are held in place by grippers, the tool comprises flexible lever structures used to dislodge the anchors from the housing or dicorotron unit in the removal step. The tool has substantially the same outer configuration of the dicorotron unit except the tool has larger dimensions enabled to permit the dicorotron unit to fit and nest therein.

The lever structures are located at opposite ends of the tool and the lever structures have projections which are adapted to dislodge the anchors and the wire electrode from the dicorotron unit.

The tool has slots at its opposite ends. These slots are in alignment with both apertures in the dicorotron unit and with projections in the lever structures. In this embodiment, the tool is enabled after the deposit step and emptied of the wire assembly to provide a tool to remove a wire assembly in a removal step involving a second dicorotron unit containing a faulty wire assembly.

In summary, in an embodiment, the tool is enabled to both remove and insert or deposit a wire electrode assembly in a dicorotron unit. The tool has a substantially elongated configuration and is enabled to mate with and receive a dicorotron unit. Also, the tool is adapted to permit the dicorotron unit to nest therein. The tool when devoid of a wire assembly is adapted to remove a faulty used wire assembly from a dicorotron unit in a removal step. The tool when loaded with a new wire assembly is adapted to insert or deposit the new wire assembly in a previously empty dicorotron unit in a deposit step. The wire assembly throughout this disclosure comprises a wire electrode strung between two insulating anchors. The anchors are movably held in position by pliable grippers. This tool comprises flexible levers at both of its end portions. The flexible levers have inwardly pointed projections. These projections are adapted to dislodge the anchors from the housing in the removal step. The levers are located on a front side portion of the tool and are flexibly attached thereto. The tool is enabled after the deposit or insertion step and emptied of the wire assembly to provide a tool to remove a wire assembly in a removal step involving a second dicorotron unit with a faulty wire assembly.

Both the dicorotron unit and the tool have a U-shaped configuration. The tool in one embodiment is constructed of a molded plastic and the flexible levers are operatively connected to a front side portion of the tool. Any suitable material may be used to construct the tool. The tool comprises, after the deposit step, an open top portion adapted to contact and receive from a dicorotron unit a faulty wire assembly during a removal step.

DETAILED DISCUSSION OF DRAWINGS AND PREFERRED EMBODIMENTS

Figure 1:
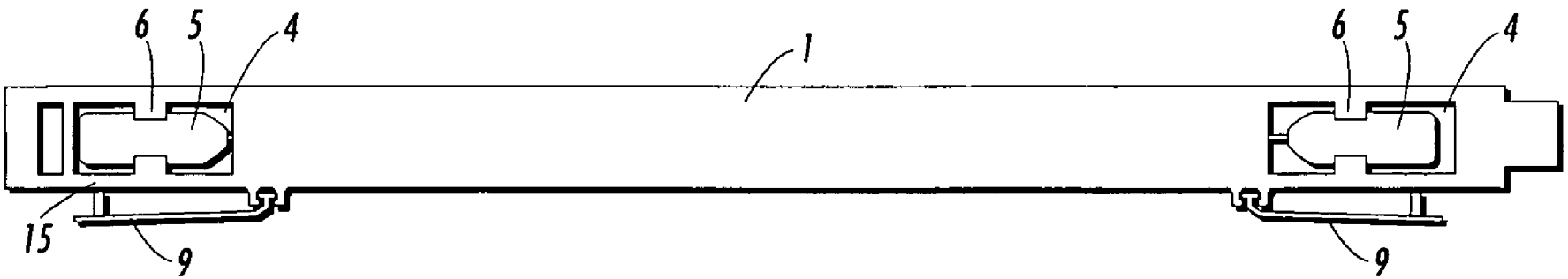
FIG. 1 illustrates in a top view an embodiment where the removal-insertion tool (tool) is loaded with a new wire assembly ready for insertion of this wire assembly in an empty dicorotron unit.

In FIG. 1 the removal-insertion tool 1 (tool) is shown from a top view. The tool contains a new wire assembly 2 ready to be deposited into an empty dicorotron unit 3 (see FIGS. 4 and 5). At the top end sections of the tool 1 are openings 4 which expose anchors 5 which are held in place by grippers 6. To deposit a new wire assembly 2 in an empty dicorotron unit 3, the tool 1 containing a new wire assembly 2 is placed open face 11 over the open surface 8 of the dicorotron unit 3, thereby fitting the dicorotron unit 3 into the insertion tool 1. The insertion tool 1 is pulled upwards while pushing the user's thumbs through openings 4 on the top of the tool to release a new wire assembly 2 into the emptied dicorotron unit's U-shaped housing 3. The thumbs push the anchors 5 loose, thereby releasing the entire new wire assembly 2. The grippers 6 holding anchors 5 of the wire assembly 2 snap into the apertures 7 located at the end of the U-shaped housing 3. When the grippers 6 snap into the apertures 7, the new wire assembly 2 is now fixed into the dicorotron unit (U-shaped housing). Levers 9 may also be used to dislodge anchors 5 from grippers 6. Levers 9 have projections 10 that push against grippers 6 to dislodge the anchors 5.

Figure 2:
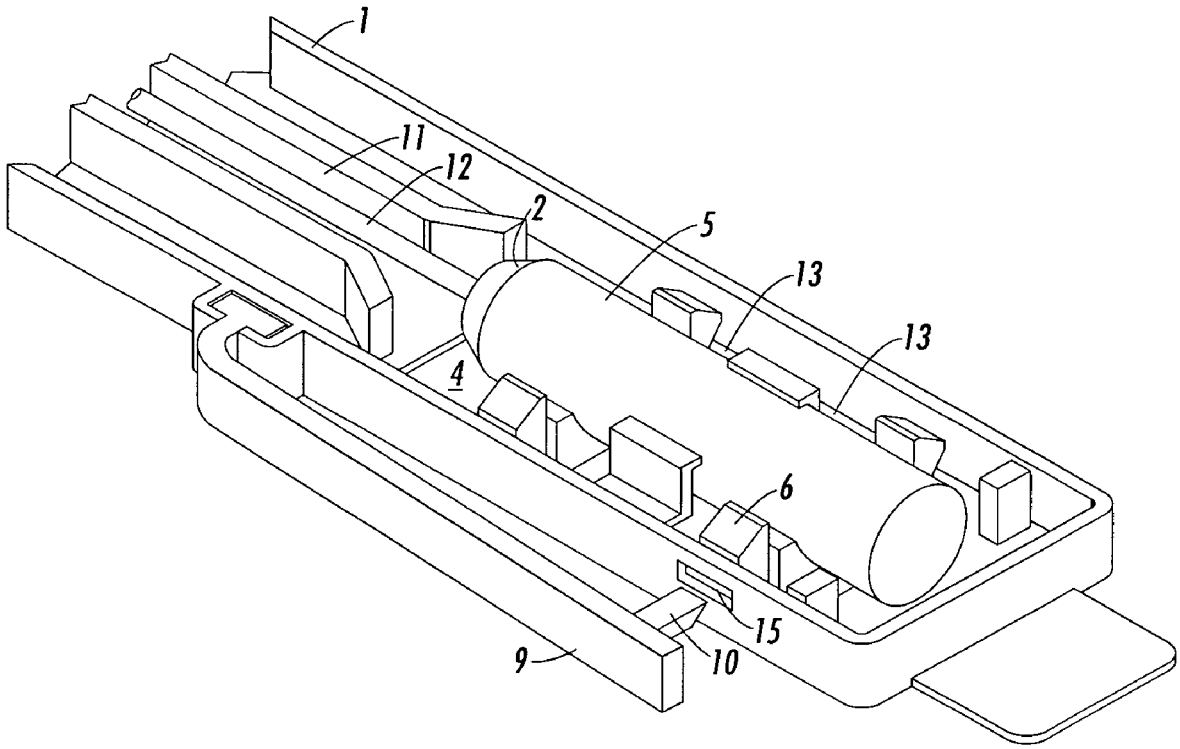
FIG. 2 is an enlarged bottom end section of the tool loaded with a new wire assembly.

FIG. 2 is an enlarged end bottom section (or open face 11 of tool) illustrating the wire assembly 2 made up of anchors 5, grippers 6 and wire electrode 12. The grippers 6 are attached to anchors 5 and move with anchors 5, whether being dislodged or deposited in a dicorotron unit 3. FIG. 4 clearly shows a dislodged wire assembly 2, either after being removed from dicorotron unit 3 or before being inserted into dicorotron unit 3 by tool 1. The grippers 6 are movably resting on the side rails 13 of the tool 1. FIG. 2 shows a bottom view of tool 1, whereas FIGS. 1 and 3 show a top view of tool 1.

Figure 3:
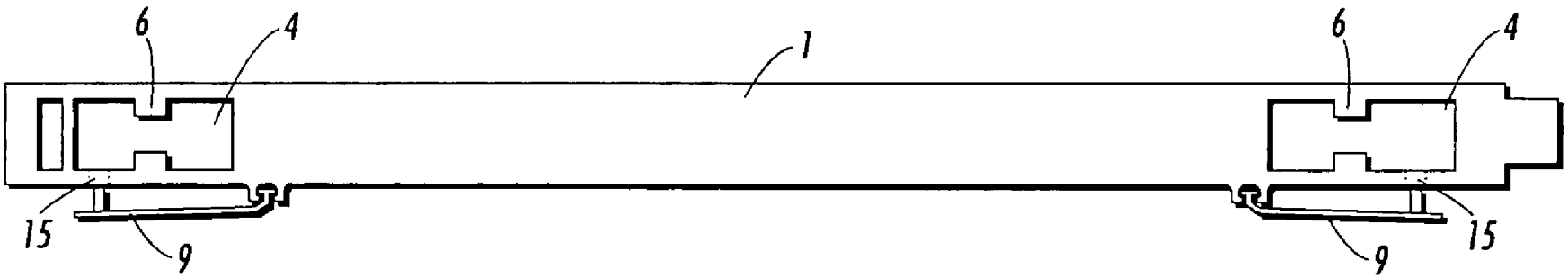
FIG. 3 is a top view of an empty tool after it has deposited the new wire assembly in an empty dicorotron unit.
Figure 4:
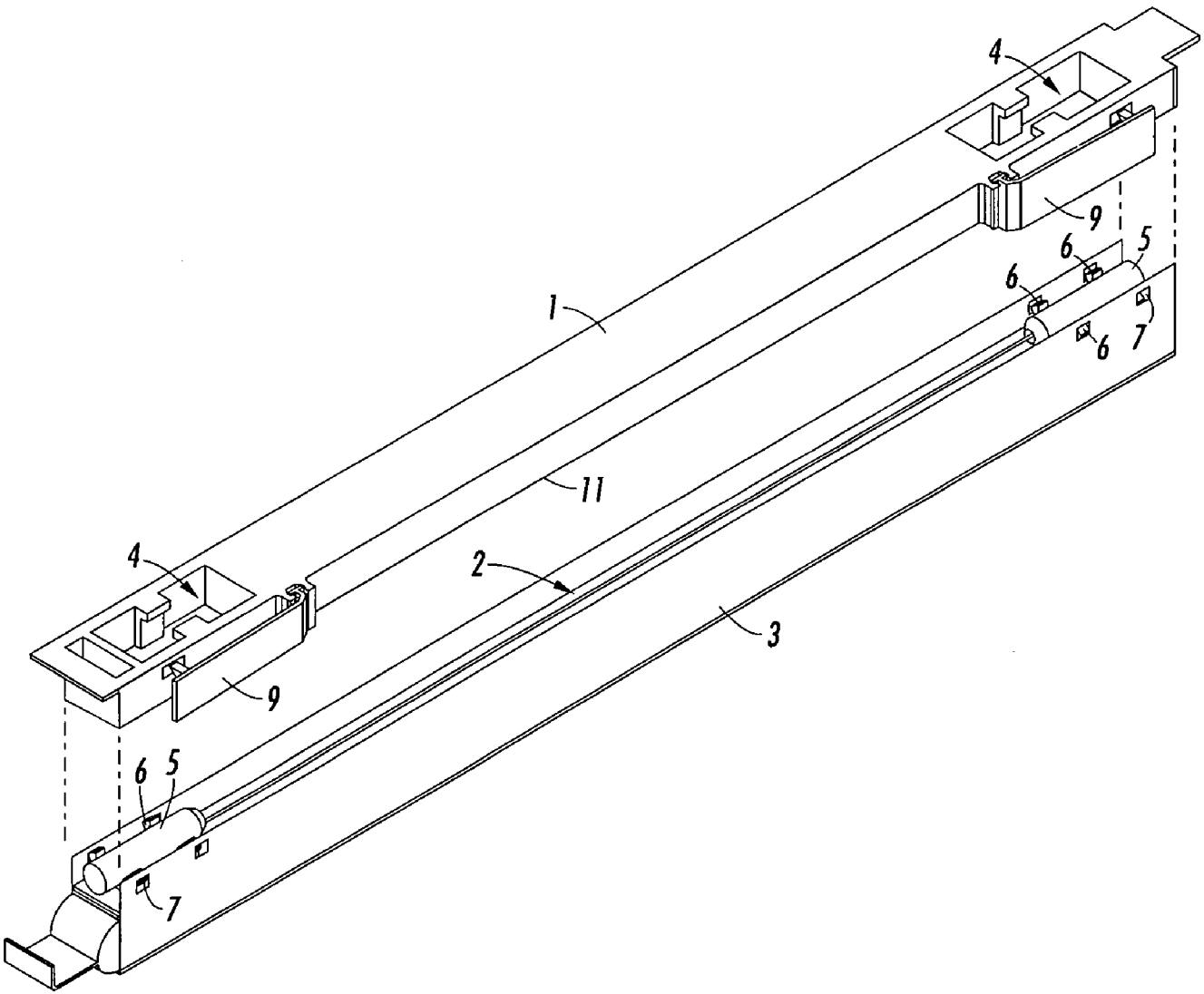
FIG. 4 illustrates an embodiment where the tool has deposited a new wire assembly into the dicorotron unit.

In FIG. 3 an emptied tool 1 is shown after the wire assembly 2 has been transferred to dicorotron unit 1. This emptied tool 1 can now be used as a wire assembly 2 removal tool to dislodge a faulty wire assembly 2 from a second dicorotron unit 3. As noted earlier, the tool 1 has the same configuration as the dicorotron unit 3, only the dimensions of the tool 1 are large enough for the dicorotron unit 1 to fit therein.

In FIG. 4, the tool 1 is fitted over the dicorotron unit 3 so that the dicorotron unit 3 is covered so aperture 7 are aligned with the projection 10 of tool 1. As shown in FIG. 1 openings 4 at the top of tool expose anchors 5. Anchors 5 are pushed downward through openings 4 so that grippers 6 snap into apertures 7 in the dicorotron unit 3 to thereby fit a new wire assembly 2 into housing or dicorotron unit 3.

Figure 5A:
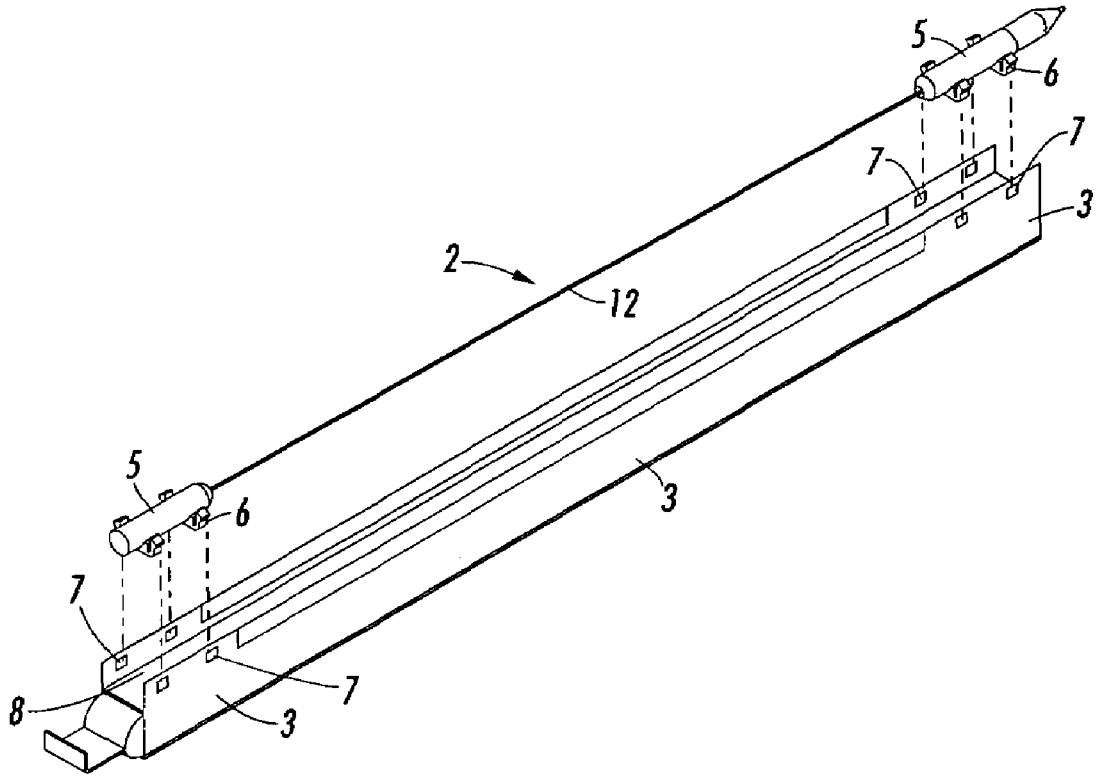
FIG. 5A illustrates in a top side perspective view an embodiment where an empty dicorotron unit is about to receive a new wire assembly.

FIG. 5A illustrates whereby an empty dicorotron unit 3 has old wire assembly 2 removed from it or a new wire assembly deposited into it; for clarity, the tool 1 is not shown but FIG. 4 clearly illustrates the tool 1 and dicorotron unit 3 placements. This FIG. 5A is to illustrate that the entire wire assembly 2, which comprises wire electrode 12, anchors 5 and grippers 6 are either removed as a unit or deposited as a unit; i.e. anchors 6, wire electrode 12 and grippers 6. Open face 8 of the dicorotron unit 3 is adjacent the open face 11 of tool when the removal or deposit of the wire assembly takes place.

Figure 5B:
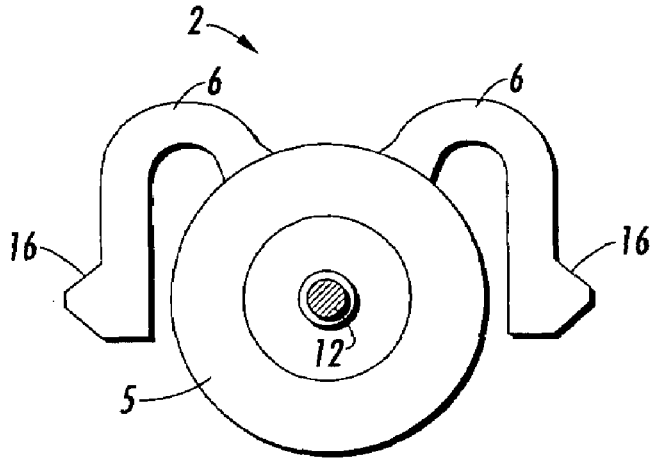
FIG. 5B illustrates an end view of the wire assembly of an embodiment.

FIG. 5B shows an end view of wire assembly 2, which comprises anchors 5, wire electrode 12 and grippers 6. The grippers 6 fit into apertures 7 in the dicorotron unit 3 when the wire assembly is in place. Grippers 6 are removed from apertures 7 when the wire assembly 2 is removed or dislodged by tool 1 from the dicorotron unit 3.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A tool enabled to both remove or deposit a wire electrode assembly in a dicorotron unit, said tool having a substantially elongated configuration with openings in its end top portions and enabled to mate with and receive a dicorotron unit, said tool adapted to permit said dicorotron unit to nest therein, said tool in a removal step and when devoid of a wire assembly adapted to remove a faulty used wire assembly from a dicorotron unit said dicorotron unit having apertures at each end portion said tool when loaded with a new wire assembly adapted to insert or deposit said new wire assembly in a previously empty dicorotron unit in a deposit step, said openings in a top portion adapted to permit a user to push a wire assembly from said tool to said dicorotron unit, said wire assembly comprising grippers, and a wire electrode strung between two insulating anchors, said anchors movably held in position by said grippers and adapted to be dislodged from said tool when a user pushes said wire assembly from said tool to said dicorotron unit, said tool comprising flexible levers at both of its end portions, said flexible levers having inwardly pointed projections, said projections adapted to dislodge said anchors from said dicorotron unit in said removal step, said levers located on a front side portion of said tool and flexibly attached thereto.

2. The tool of claim 1 wherein said tool has substantially the same outer configuration of said dicorotron unit except that said tool had dimensions large enough to permit said dicorotron unit to fit and rest therein, said tool having levers with projections that are aligned with slots in said tool and apertures in said dicorotron unit.

3. The tool of claim 1 herein said tool is enabled after said insertion or deposit step and emptied of said wire assembly to provide a tool to subsequently remove a wire assembly in a removal step involving a second dicorotron unit with a faulty wire assembly.

4. The tool of claim 1 wherein both said dicorotron unit and said tool have a U-shaped configuration, said tool having said openings in its end top portions, said openings adjacent to said anchors and enabled to allow a user access to said anchors, said anchors in said wire assembly when pushed are enabled to be transferred from said tool to said dicorotron unit.

5. The tool of claim 1 wherein said tool is constructed of a molded plastic and wherein said flexible levers are operatively connected to a front side portion of said tool, said tool also having openings on its top end portions that permit access to said anchors in said deposit step.

6. The tool of claim 1 comprising in said insertion or deposit or step a new removable wire assembly which is enabled to be transferred from said tool to an empty dicorotron unit, said tool having said openings adjacent said anchors, said openings enabling a user to have access to said anchors to dislodge them from said tool and to be transferred to said dicorotron unit.

7. The tool of claim 1 comprising in said deposit step an open top portion adapted to contact and receive a dicorotron unit and to remove from said dicorotron unit a faulty wire assembly during a removal step.

8. The tool of claim 1 having therein a new wire assembly, which is adapted to be transferred from said tool to said dicorotron unit in said deposit step, said wire assembly comprising said grippers, said anchors and said wire electrode all connected to each other and adapted to be transferred from said tool to said empty dicorotron unit upon pushing said anchors from said tool until said grippers snap and lock into said apertures in said dicorotron unit.

9. A tool enabled to remove or insert a wire electrode assembly in a dicorotron unit, said tool when devoid of a wire assembly adapted to remove a faulty used wire assembly from a dicorotron unit in a removal step, said tool when armed with a new wire assembly adapted to insert and deposit said new wire assembly in said dicorotron unit in a deposit step, said tool comprising structures to both remove and insert a wire assembly from and into said dicorotron unit, said tool has slots therein that will align both with apertures in said dicorotron unit and with projections located in levers of said tool, said projections adapted to travel through said slots and said apertures when contacting said faulty wire assembly.

10. A tool enabled to both remove and deposit a wire electrode assembly in a dicorotron unit, said tool having a substantially elongated configuration enabled to mate with a dicorotron unit, said tool adapted to receive said dicorotron unit in a manner whereby said dicorotron unit can nest therein, said tool when devoid of a wire assembly in a removal step adapted to remove a faulty used wire assembly from a dicorotron unit, said tool in a deposit step when loaded or armed with a new wire assembly adapted to insert or deposit said new wire assembly in a heretofore empty dicorotron unit, said wire assembly comprising grippers, a wire electrode strung between two insulating anchors, said anchors held in place by said grippers, said tool comprising flexible lever structures used to dislodge said anchors from said dicorotron unit in said removal step and in said removal step wherein said tool has slots at opposite ends of said tool, said slots are in alignment when used with both apertures in said dicorotron unit and with projections in said lever structures, said projections adapted to travel through said slots and said apertures when contacting said faulty wire assembly.

* * * * *